US008820032B2

(12) United States Patent
Badger et al.

(10) Patent No.: US 8,820,032 B2
(45) Date of Patent: Sep. 2, 2014

(54) DOOR WITH ASSEMBLY OF STILES AND RAILS

(71) Applicant: ProVia Door, Inc., Sugarcreek, OH (US)

(72) Inventors: Chad Badger, Fredericksburg, OH (US); Scott Widmer, Dalton, OH (US); Bill Mullet, Sugarcreek, OH (US)

(73) Assignee: ProVia Door, Inc., Sugarcreek, OH (US)

( * ) Notice: Subject to any disclaimer, the term of this patent is extended or adjusted under 35 U.S.C. 154(b) by 0 days.

(21) Appl. No.: 13/676,663

(22) Filed: Nov. 14, 2012

(65) Prior Publication Data

US 2014/0130448 A1 May 15, 2014

(51) Int. Cl.
*E04C 2/54* (2006.01)

(52) U.S. Cl.
USPC ..... 52/784.1; 52/309.9; 52/797.1

(58) Field of Classification Search
USPC ..... 52/455, 309.9, 309.14, 784.1, 784.11, 52/784.15, 797.1, 802.1, 784.16
See application file for complete search history.

(56) References Cited

U.S. PATENT DOCUMENTS

| | | | | |
|---|---|---|---|---|
| 3,750,333 | A * | 8/1973 | Vance | 49/501 |
| 3,885,351 | A * | 5/1975 | Imperial et al. | 49/501 |
| 4,807,396 | A * | 2/1989 | Heikkinen | 49/470 |
| 5,325,648 | A * | 7/1994 | Menard | 52/456 |
| 6,112,496 | A * | 9/2000 | Hugus et al. | 52/784.11 |
| 6,619,005 | B1 * | 9/2003 | Chen | 52/455 |
| 2003/0145542 | A1 * | 8/2003 | Chen | 52/309.9 |
| 2009/0025325 | A1 * | 1/2009 | Gillespie et al. | 52/309.14 |
| 2009/0165415 | A1 * | 7/2009 | Salerno | 52/455 |

* cited by examiner

*Primary Examiner* — Brian Glessner
*Assistant Examiner* — Brian D Mattei
(74) *Attorney, Agent, or Firm* — McDonald Hopkins LLC

(57) ABSTRACT

An entry door is shown and described. The entry door may include a first skin, a second skin, and at least one stile formed from a plurality of interconnected members attached together. The entry door may also include at least one rail formed from a plurality of interconnected members attached together, where the at least one rail and stile are positioned between and secured with the first and second skins forming a cavity between the first and second skins, and an insulative material positioned between the first and second skins generally filling the cavity.

39 Claims, 7 Drawing Sheets

DOOR WITH ASSEMBLY OF STILES AND RAILS

FIELD OF INVENTION

The present invention relates generally to an entry door, and more particularly, to an entry door formed with an assembly of stiles and rails.

BACKGROUND

Entry doors for residences, business, and industrial facilities often suffer from shortcomings in their design. One popular design is a door formed from wood. Since wood is generally light and can be shaped and cut easily, wooden doors can be manipulated to meet a lot of differing needs and requirements. Wooden doors, however, are often more susceptible to harsh environmental conditions. Still further, wooden doors have a fixed insulative capacity that cannot generally be altered without significant costs and design issues.

Steel or metal doors, on the other hand, provide strength and the ability to withstand extreme environmental conditions. Due to the heavy material, the metal doors generally have a hollow cavity in order to substantially reduce the overall weight. Often this cavity is filled with a wood material, which similarly causes the door to have a fixed insulative capacity that cannot generally be altered without significant costs and design issues. The metal door with the cavity filled with wood can still be heavy and difficult to install.

Traditionally, the metal door was manufactured with two door skins if the top and bottom pieces were manufactured integral to the respective door skins or four pieces if the top and bottom pieces were not integral to one of the door skins. One traditional method of manufacturing the door is to weld the pieces together at the seams. The welded door provides great resistance to the harsh environment and can generally withstand fires, but suffers from being a time consuming and costly procedure as well as being unattractive.

The welded door is unattractive due to the welded seams that contain a variety of bumps and ridges from the welding process. Further, the welding process is generally unreliable and may cause material flexing and fitment issues due to the extreme heat required to weld the door together. Further still, the welded door is costly to produce because an acceptable door must be prepped for welding and then welded. Not only is welding expensive and time consuming, the unattractive seams that result must be sanded and polished to provide an acceptable finish. The sanding and polishing procedures are objectionable because they are both labor intensive and messy.

Further still, these types of entry doors are limited in the available points of contact between the door and applicable building structure. This may create additional gaps through which environmental conditions may enter, e.g., hot or cold air. The door may then not offer suitable insulation to the opening, which may increase heating and cooling costs.

Therefore, there is a need for an improved door that may be formed from skins and that can be manufactured in a more efficient and cost effective manner and that may be easier to install due to a lower weight. Further, there is a need for a door that may exhibit good protection from environmental conditions and that can provide additional insulative capacity. Further still, there is a need for an entry door that may be formed to contact additional components of the building structure to which it is attached to provide a better seal between the building structure and environment.

SUMMARY

An entry door is shown and described. The entry door may include a first skin, a second skin, and at least one stile formed from a plurality of interconnected members attached together. The entry door may also include at least one rail formed from a plurality of interconnected members attached together, where the at least one rail and stile are positioned between and secured with the first and second skins forming a cavity between the first and second skins, and an insulative material positioned between the first and second skins generally filling the cavity.

An entry door may include a first skin, a second skin, and a pair of stiles formed from a plurality of interconnected members attached together. The entry door may also include a pair of rails formed from a plurality of interconnected members attached together, where the pair of stiles and rails are positioned between and secured with the first and second skins forming a cavity between the first and second skins, and an edge member attached to at least one of the pair of stiles, where the edge member includes a generally perpendicular internal corner capable of engaging at least two surfaces of a jamb.

An entry door may include a jamb attachable to an opening in a building structure, the jamb having a width, a first skin, a second skin, and a pair of stiles formed from a plurality of interconnected members attached together. The entry door may also include a pair of rails formed from a plurality of interconnected members attached together, where the pair of stiles and rails are attached together, positioned between and secured with the first and second skins forming a cavity between the first and second skins whereby at least one of the pair of stiles is connected with the jamb, and where the first and second skins extend beyond the width of the jamb.

BRIEF DESCRIPTION OF THE DRAWINGS

Operation of the invention may be better understood by reference to the detailed description taken in connection with the following illustrations, wherein.

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

Figure 1:
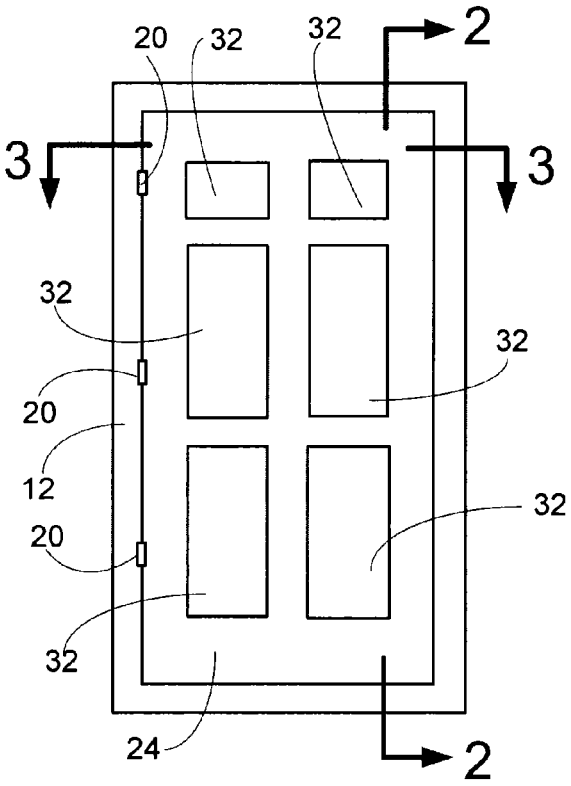
FIG. 1 is a front view of an entry door of the present teachings.

An entry door 10 capable of being attached to a building structure, or more specifically to any appropriate jamb frame 12 at an entrance to the building structure is shown in FIG. 1. The entry door 10 may be of any appropriate shape and size, the present teachings are not limited to the shape and size of the entry door 10 shown and described herein. These are merely exemplary embodiments of the entry door 10. While the entry door 10 is shown and described as being a door to enter a structure, it may also be an internal door, closet door, or any other type of door; the present teachings are not limited to the use and type of door shown and described.

When terms such as "inner," "outer," "lower," "upper," "horizontal," and "vertical" are used herein, reference is made to the entry door 10 of the present teachings when oriented as shown, for example, in FIG. 1. It should be understood that such terms are used in their relative senses and are intended to be are merely exemplary and not all-inclusive nor exclusive.

The entry door 10 may be secured with the jamb frame 12 using hinges 20. The hinges 20 may be any suitable type of hinges as the present teachings are not limited to a specific type of hinge. The hinges 20 may be attached to the entry door 10 and the jamb frame 12 in any appropriate manner, such as by way of a non-limiting example using fasteners (not shown). Any type of fasteners may be used.

The entry door 10 may include a first skin 24 and a second skin 28. Either of the first and second skins 24, 28 may face an interior of the building structure whereby the other of the first or second skins 24, 28 may face an exterior of the building structure. If the entry door 10 is utilized as an interior door, the first and second skins 24, 28 may refer to any side of the entry door 10. The first and second skins 24, 28 may be formed of any appropriate material, including, by way of non-limiting examples, steel, fiberglass, aluminum or any other appropriate material. The first and second skins 24, 28 may be formed of the same material, or in the alternative, the first and second skins 24, 28 may be formed from different materials. By way of a non-limiting example, the first skin 24 may be steel or fiberglass and the second skin 28 may be the other of fiberglass or steel.

The first and second skins 24, 28 may have any appropriate decorative finish or none at all. For example, the first skin 24 may include a plurality of decorative panels 32 formed therein, such as shown in FIG. 1. The first skin 24 may have generally the same decorative finish as the second skin 28 such that the second skin 28 includes similar decorative panels 32 formed therein. In the alternative, the first skin 24 and second skin 28 may have generally different decorative finishes. The present teachings are not limited to a specific decorative finish. By way of non-limiting examples, the first and second skins 24, 28 may include any decorative finish like windows, textured wood grain, generally smooth finish, and the like. Further, the finish may be stainable to match interior trim or other appropriate components or paintable to match an exterior of a building or to be in compliance with homeowner's association guidelines.

The entry door 10 may further include a rail and stile structure 40 secured with the first and second skins 24, 28 in any appropriate manner. By way of a non-limiting example, the rail and stile structure 40 may be adhered, welded, fastened or the like to both of the first and second skins 24, 28. The first skin 24 may be secured by a first method and the second skin 28 may be secured in a second manner whereby the first and second manners are different. Alternatively, the first and second skins 24, 28 may be secured in the same manner.

The rail and stile structure 40 may be adhered to the first or second skins 24, 28 using any appropriate adhesive, such as epoxies, urethanes, hot melts, silicones and the like or a combination of such. The rail and stile structure 40 may also be welded to the first or second skins 24, 28 such as through sonic welding, heat welding, and the like. Still further, the rail and stile structure 40 may be fastened such as through fasteners, fastening devices, integrally formed fastening devices, monolithically formed fastening devices and the like.

The rail and stile structure 40 may be formed in any appropriate manner. Exemplary embodiments of the rail and stile structure 40 secured with the first and second skins 24, 28 are shown in cross-section in FIGS. 2 and 3. The rail and stile structure 40 being secured with the first and second skins 24, 28 may form at least a portion of the entry door 10. The rail and stile structure 40 may be formed of any appropriate material, including, without limitation, fiberglass, plastic, and rubber. Further, the rail and stile structure 40 may be formed from a pultruded material such as polyurethane, or sheet molding compound fiberglass. The rail and stile structure 40 may serve as a frame like structure to the entry door 10 to which the first and second skins 24, 28 may be attached. The rail and stile structure 40 may be of a configuration to provide the appropriate rigidity and structure to the entry door 10.

The rail and stile structure 40 may include a plurality of components operatively attached to one another to which the first and second skins 24, 28 may be secured. In an exemplary embodiment, the rail and stile structure 40 may include a pair of side stile assemblies 42, top rail assembly 44 and bottom rail assembly 46. The components may all be attached together in any suitable manner forming the rail and stile structure 40. The side stile assemblies 42 may be a mirror image of one another, or may be of a different configuration. The present teachings are not limited to either configuration. In a non-limiting example, one of the side stile assemblies 42 may be a hinge stile while the other of the side stile assemblies 42 may be a lock stile. In such embodiments, the hinge stile may be connected with the hinges 20 and connected with the jamb frame 12. The lock stile may be selectively secured with the jamb frame 12 upon closing of the entry door 10 and may include a lock (not shown) that may lock the entry door 10 with respect to the jamb frame 12 preventing further movement thereof.

Figure 11:
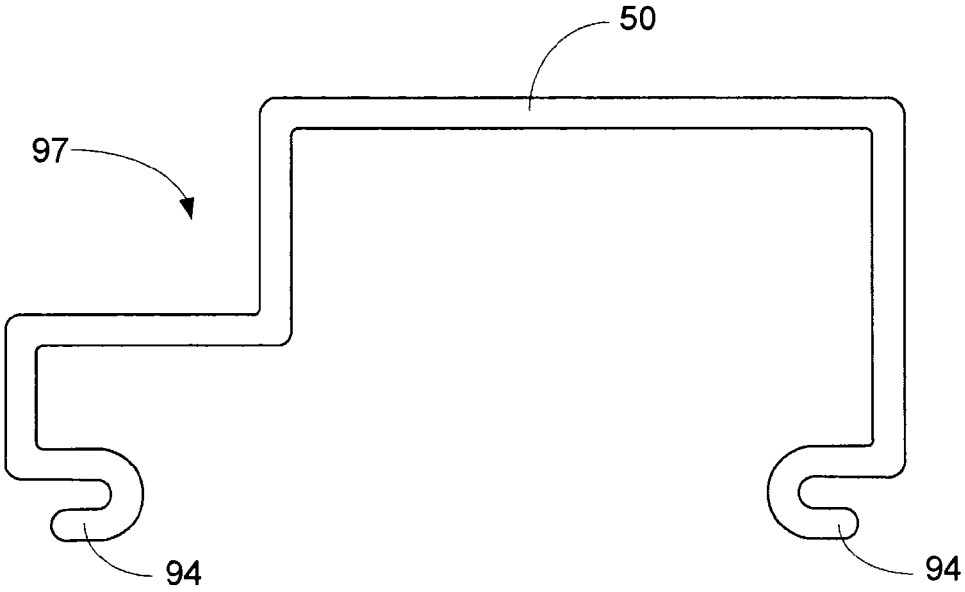
FIG. 11 is a front view of a portion of a rail structure of an entry door.
Figure 12:
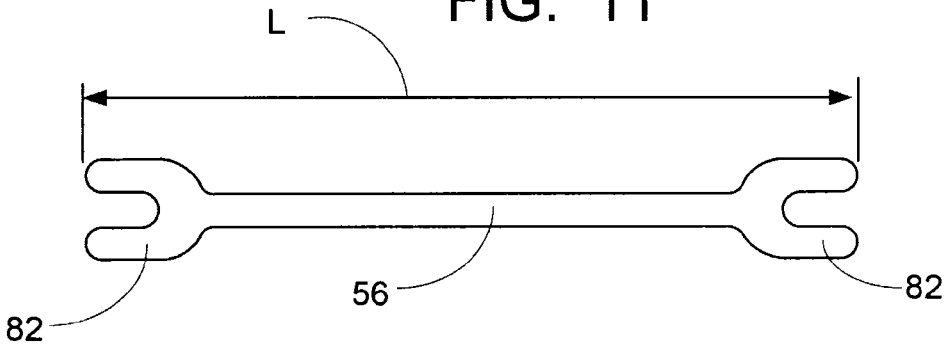
FIG. 12 is a front view of a portion of a rail structure of an entry door.
Figure 13:
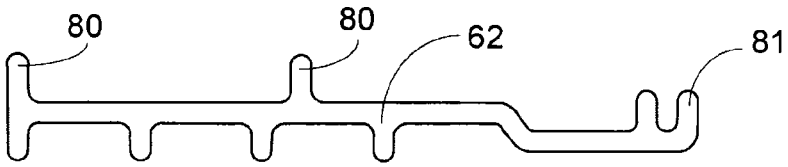
FIG. 13 is a front view of a portion of a rail structure of an entry door.
Figure 14:
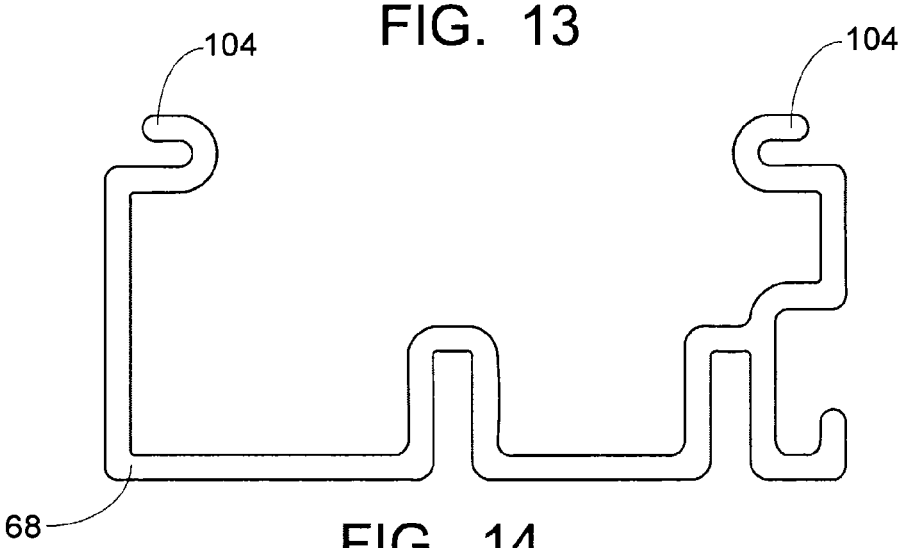
FIG. 14 is a front view of a portion of a rail structure of an entry door.
Figure 15:
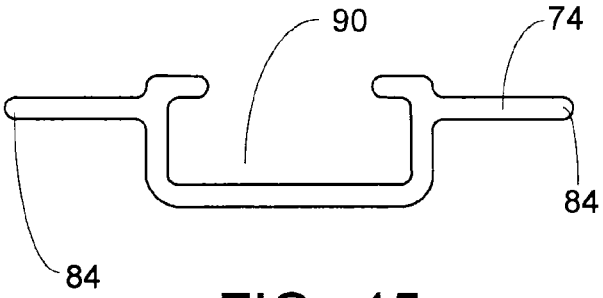
FIG. 15 is a front view of a portion of a rail structure of an entry door.
Figure 16:
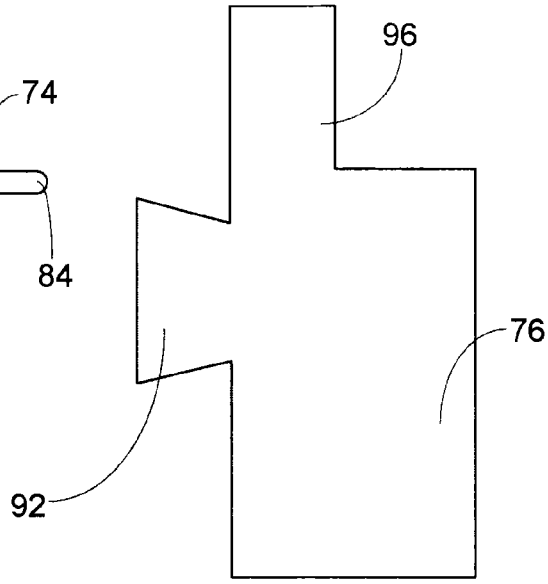
FIG. 16 is a cross-sectional view of a portion of an entry door.
Figure 17:
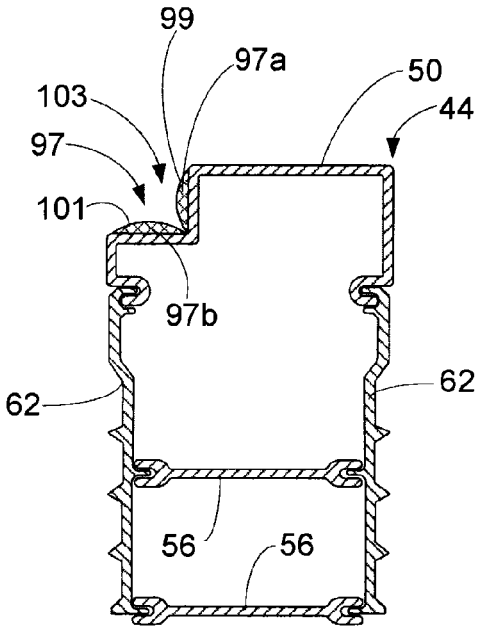
FIG. 17 is a cross-sectional view of the rail structure of the entry door of FIG. 7 along line 8-8.
Figure 18:
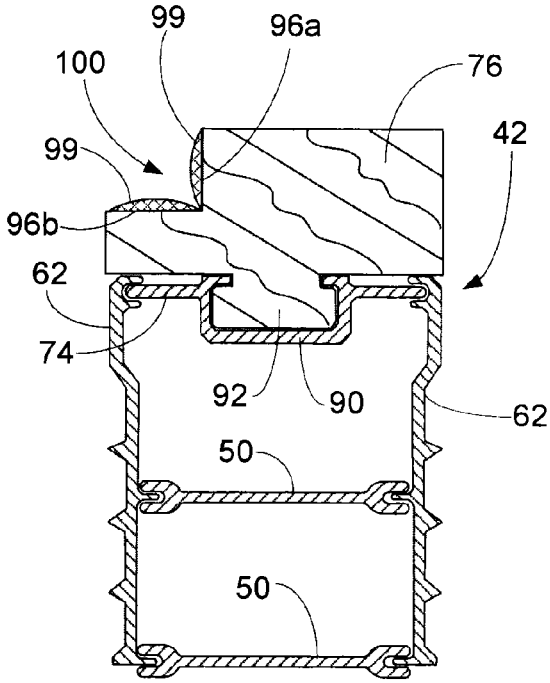
FIG. 18 is a cross-sectional view of the rail structure an portions of the entry door of FIG. 7 along line 9-9.

More specifically, the rail and stile structure 40 may include at least the following components: a header 50, such as shown in FIG. 11, an internal connection member 56 such as shown in FIG. 12, a side member 62, such as shown in FIG. 13, a bottom member 68 such as shown in FIG. 14, and an edge member 74 such as shown in FIG. 15. While specific configurations of the header 50, internal connection member 56, side member 62, bottom member 68 and edge member 74 are shown in FIGS. 2-9, the present teachings are not limited to such. Any appropriate configuration of the header 50, internal connection member 56, side member 62, bottom member 68 and edge member 74 may be used without departing from the present teachings.

Figure 3:
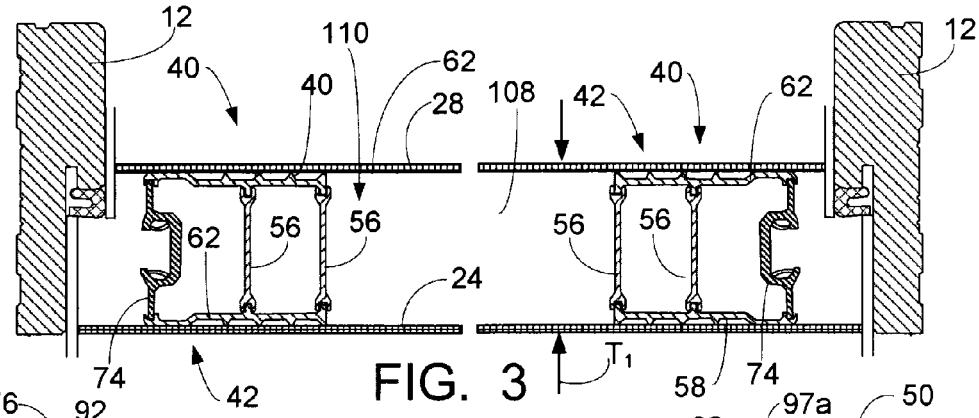
FIG. 3 is a horizontal cross-sectional view of the door of FIG. 1 along line 3-3.
Figure 4:
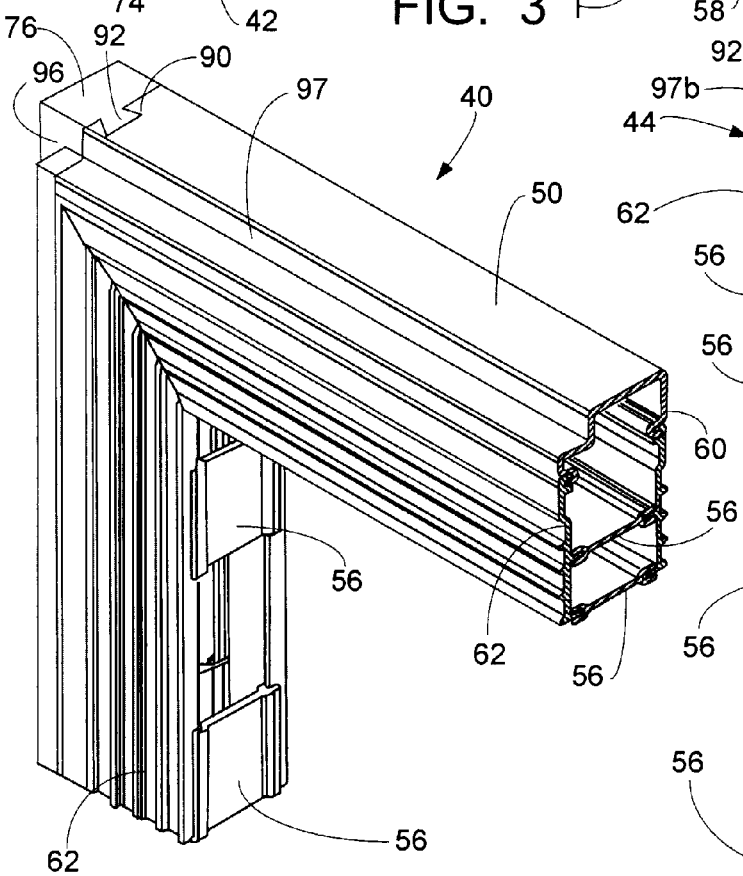
FIG. 4 is a perspective view of a portion of a rail structure of an entry door.
Figure 5:
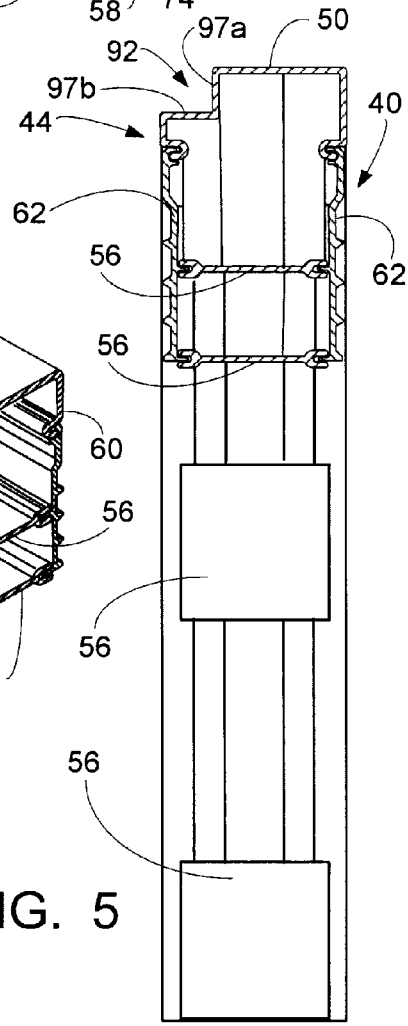
FIG. 5 is a first elevation view of a portion of a rail structure of an entry door.
Figure 6:
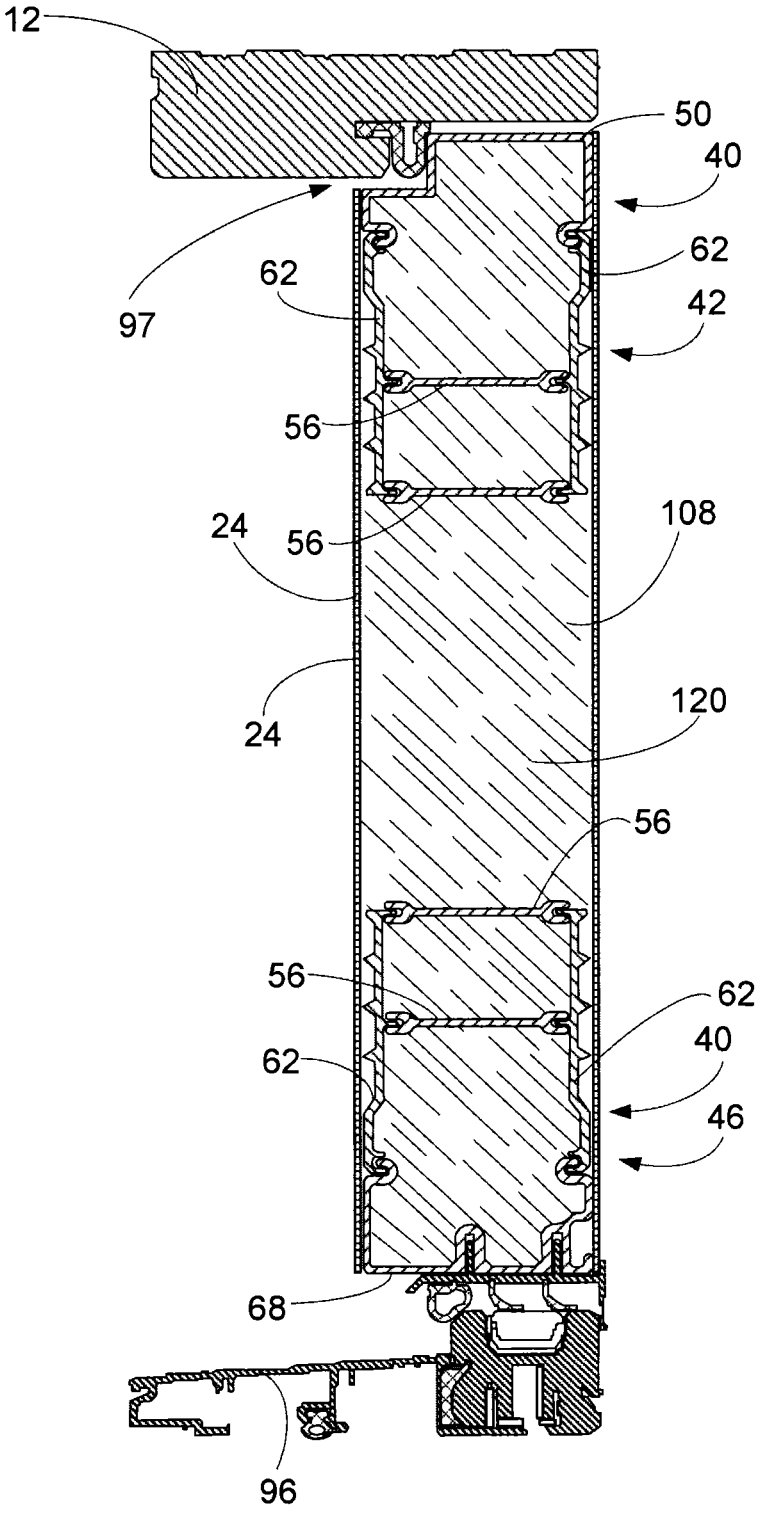
FIG. 6 is a vertical cross-sectional view of the door of FIG. 1 along line 2-2 with an insulative material added therein.
Figure 7:
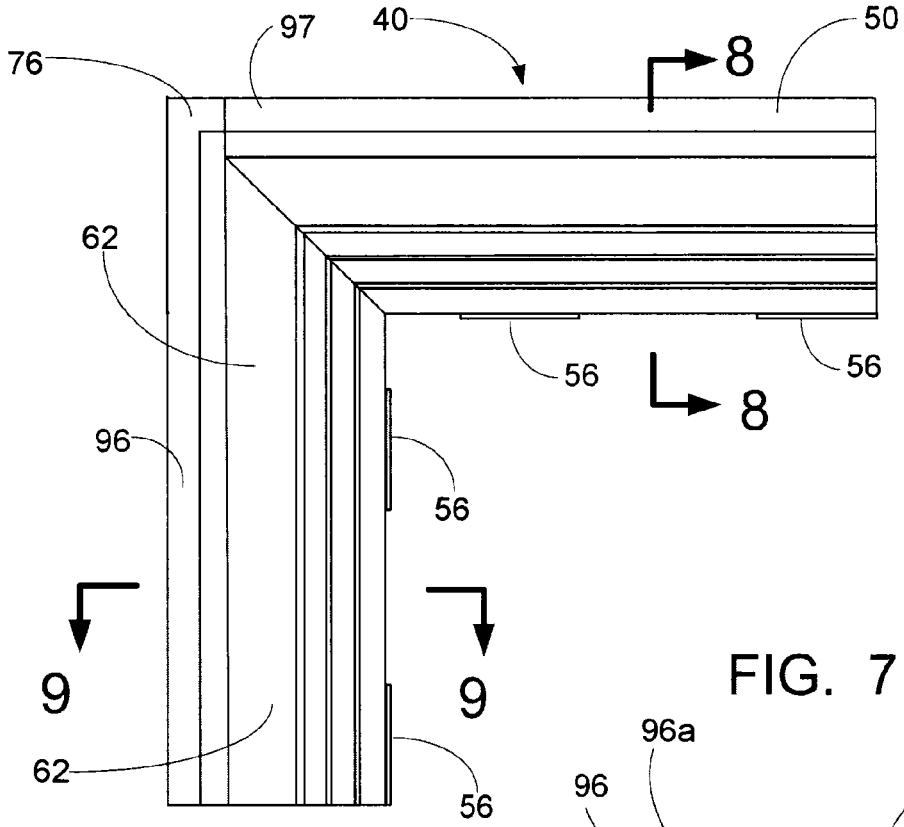
FIG. 7 is a front view of a portion of a rail structure of an entry door.
Figure 8:
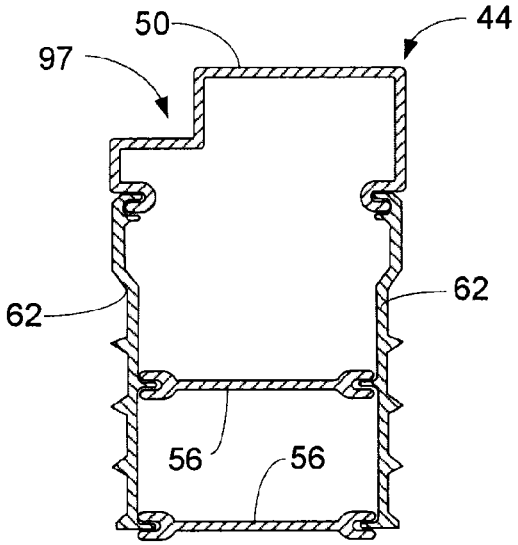
FIG. 8 is a cross-sectional view of the rail structure of the entry door of FIG. 7 along line 8-8.
Figure 9:
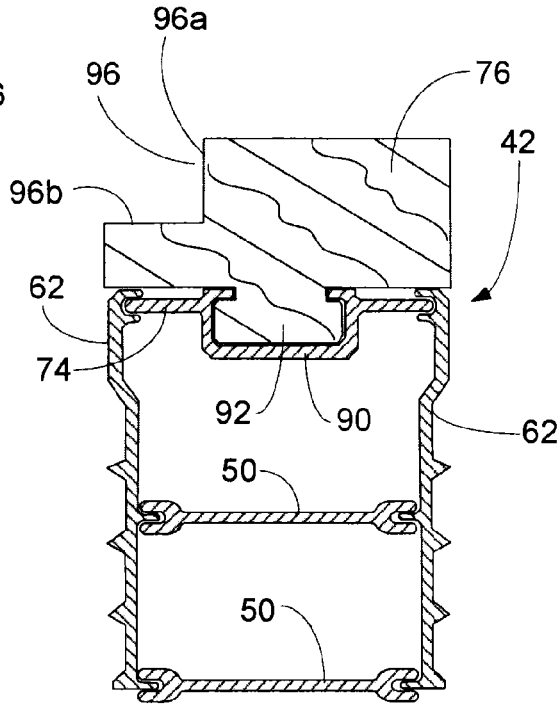
FIG. 9 is a cross-sectional view of the rail structure an portions of the entry door of FIG. 7 along line 9-9.
Figure 10:
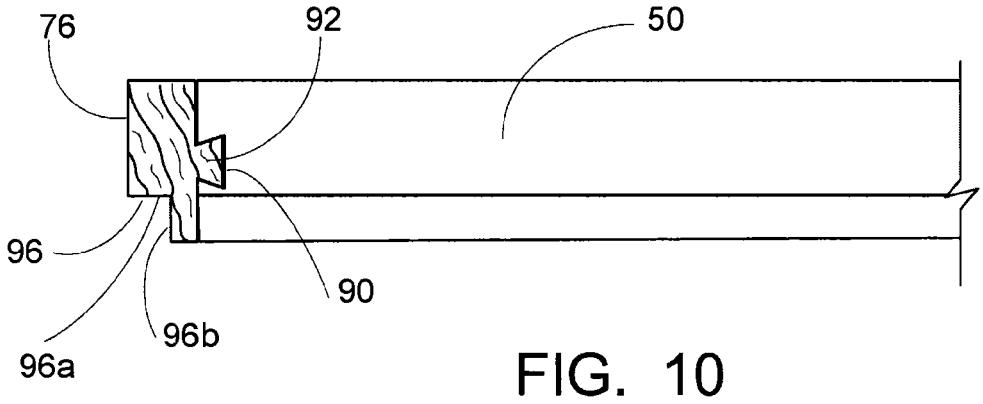
FIG. 10 is a plan view of a rail structure and a portion of an entry door.

The side stile assemblies 42 may be formed by attaching the edge member 74 with at least one side member 62 and at least one internal connection member 56. The side stile assemblies 42 may further include an end member 76, which is described in more detail below. More specifically, and as shown in the embodiment of FIGS. 3 and 9, the side stile assemblies 42 may be formed from attaching the edge member 74 between a pair of the side members 62. Additionally, a pair of the internal connection members 56 may be attached to the side members 62. Next, the edge member 74 may be attached to a portion of the end member 76 in any appropriate manner, such as through adhesives, fastening, engaging or any combination of such. It should be understood, however, that the side stile assemblies 42 may be formed in any appropriate configuration and the components thereof may be attached in any order. They are not limited to the order described above.

In the embodiments shown, the side members 62 may include at least one snap fit member 80, the internal connection members 56 may include at least one snap fit member 82 and the edge member 74 may include at least one snap fit member 84. The snap fit members 80, 82, 84 may have any appropriate configuration such that they may be selectively engaged together as appropriate. Specifically, each of the side members 62 may include a pair of male snap fit members 80 and a female snap fit member 81; each of the internal connection members 56 may include a pair of female snap fit members 82; and the edge member 74 may include a pair of male snap members 84. The male snap fit members 80 of each of the side members 62 may engage the female snap members 82 of the internal connection members 56. Similarly, the male snap fit members 84 of the edge member 74 may engage the female snap member 81 of the side members 62. The snap fit members 80, 81, 82 and 84 may be engaged together such as through a manual hand operation, utilizing an appropriate machine, or a combination of such. Once the snap fit members 80, 81, 82 and 84 are selectively engaged, an adhesive may be used to fixedly secure the snap fit members 80, 81, 82 and 84 together. Any appropriate adhesive may be used without departing from the present teachings. Alternatively, the snap fit members 80, 81, 82 and 84 may be attached through any appropriate process, including, fastening, welding or the like.

The edge member 74 may be of a configuration that it includes a portion that matingly engages with a portion of the end member 76. By way of a non-limiting example, the edge member 74 may include a first mating portion 90—such as a female dovetail 90 as shown in FIG. 9 and the end member 76 may include a second mating portion 92—such as a male dovetail 92 also shown in FIG. 9. The first mating portion 90 may generally engage with the second mating portion 92. As shown in FIG. 9, the male dovetail member 90 may matingly engage with the female dovetail member 92. In the alternative, the edge member 74 may include a male mating member and the end member 76 may include a female mating member—the present teachings are not limited to a specific configuration. In addition, the first and second mating portions 90, 92 may be further secured together through use of adhesives, fastening, or any other suitable process. By way of a non-limiting example, the first and second mating portions 90, 92 may have adhesive applied in any appropriate manner and then the first and second mating portions 90, 92 are matingly engaged.

The end member 76 may be formed from any appropriate material. By way of a non-limiting example, the end member 76 may be generally formed of any appropriate wood material such as oak, mahogany, fir, cherry, etc. The end member 76 being wood may further add rigidity to the side stile assembly 42, and more specifically, the rail and stile structure 40 of the entry door 10. One of the pair of side stile assemblies 42 may include the end member 76, or alternatively, both of the pair of side stile assemblies 42 may include the end member 76, i.e., either or both of the hinge stile or locking stile may include the end member 76.

The end member 76 may include a generally perpendicular corner portion 96. By way of a non-limiting example, the end member 76 may be rabbeted around exterior edges thereof to generally form the perpendicular corner 96, which results in two surfaces 96*a* and 96*b*. The corner portion 96 may, when the entry door 10 is assembled, engage the door jamb 12 when the entry door 10 is attached to the building structure. The corner portion 96 being generally perpendicular may allow the entry door 10, and more specifically, the surfaces 96*a*, 96*b* of the corner portion 96 to engage a corner of the door jamb 12. This may, therefore, result in the corner portion 96 engaging two sides of the door jamb 12, i.e., surfaces 96*a* and 96*b*, as opposed to prior art entry doors that only engage a single surface. In addition, weather-stripping 99 may be attached to the end member 76, or more specifically, weather-stripping 99 may be attached to the surfaces 96*a* and 96*b* of the corner portion 96. The weather-stripping 99 may be of any appropriate configuration and design, including, without limitation being a bead of weather-stripping. This may result in the weather-stripping 99 being positioned beyond prior art weather-stripping resulting in more direct exposure to the exterior. This placement of the weather-stripping 99 may result in better properties to prevent water leakage and air or light infiltration. Specifically, a gap 100 may be formed between the two beads of weather-stripping 99 on the corner 96 of the end member 76. The gap 100 may form a cavity that may act as a weeping system for water infiltration as well as improve sound-deadening properties.

Further, the header 50 may include a corner portion 97 similar to that of the corner portion 96. By way of a non-limiting example, the corner portion 97 may be rabbeted around exterior edges thereof, which results in two surfaces 97*a* and 97*b*. The corner portion 97 may, when the entry door 10 is assembled, engage the door jamb 12 when the entry door 10 is attached to the building structure. The corner portion 97 being generally perpendicular may allow the entry door 10, and more specifically, the surfaces 97*a*, 97*b* of the corner portion 97 to engage a corner of the door jamb 12. This may, therefore, result in the corner portion 97 engaging two sides of the door jamb 12 as opposed to prior art entry doors that only engage a single surface. In addition, weather-stripping 101 may be attached to the corner portion 97 of the header 50, or more specifically, weather-stripping 101 may be attached to the surfaces 97*a* and 97*b* of the corner portion 97. The weather-stripping 101 may be of any appropriate configuration and design, including, without limitation being a bead of weather-stripping. This may result in the weather-stripping 101 being positioned beyond prior art weather-stripping resulting in more direct exposure to the exterior. This placement of the weather-stripping 101 may result in better properties to prevent water leakage and air or light infiltration. Specifically, a gap 103 may be formed between the two beads of weather-stripping 101 on the corner portion 97. The gap 103 may form a cavity that may act as a weeping system for water infiltration as well as improve sound-deadening properties. The weather-stripping 99 may be equivalent to the weather-stripping 101 or they may be of a different configuration or construction. The present teachings are not limited to a specific configuration of weather-stripping.

As the weather-stripping 99, 101 may be attached to the corner portions 96, 97 or more specifically, the surfaces 96*a*, 96*b*, 97*a*, 97*b*, respectively of the corner portions 96, 97 this may result in an additional seal over the prior art entry doors. The additional seal may provide a better insulative result for the entry door 10. The two seals may generally prevent more of the exterior environmental conditions from entering the building structure through the entry door 10 as well as generally preventing the interior environmental conditions from exiting through the entry door 10. This may provide a superior seal.

Figure 2:
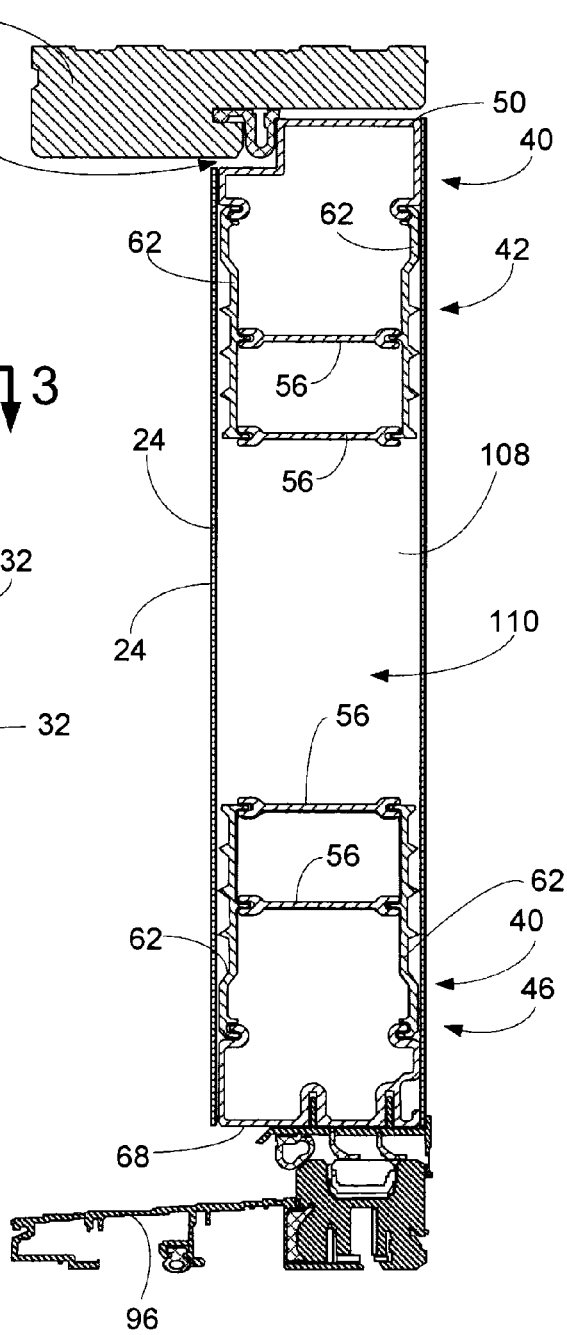
FIG. 2 is a vertical cross-sectional view of the door of FIG. 1 along line 2-2.

The top rail assembly 44 may be formed from attaching the header 50 with at least one side member 62 and at least one internal connection member 56. More specifically, and as shown in the embodiment of FIG. 2, the top rail assembly 44 may be formed from attaching the header 50 between a pair of the side members 62. Further, a pair of the internal connection members 56 may be attached to the side members 62. As noted above, the internal connection members 56 may include a pair of the snap fit female members 82 and the side members 62 may each include the pair of snap fit male members 80 and the snap fit female member 81. The header 50 may include at least one snap fit member 94, such as by way of a non-limiting example, a pair of male snap fit members 94 capable of engaging the female snap fit members 81 of each of the side members 62.

The snap fit members 80, 81, 82 and 94 may be engaged in any appropriate manner, such as shown in FIG. 2. The snap fit members 80, 81, 82 and 94 may be snap fit manually by hand, utilizing appropriate machinery or a combination of such. Once the snap fit members 80, 81, 82 and 94 are selectively engaged, an adhesive may be used to fixedly engage the snap fit members 80, 81, 82 and 94 together. Any appropriate adhesive may be used without departing from the present teachings. Alternatively, the snap fit members 80, 81, 82 and 94 may be fixed together through any appropriate process, including, without limitation, fastening, welding or the like. Attaching the snap fit members 80, 81, 82 and 94 as indicated above may form the top rail assembly 44.

The bottom rail assembly 46 may formed from attaching the bottom member 68 with at least one side member 62 and at least one internal connection member 56. More specifically, and as shown in the embodiment of FIG. 2, the bottom rail assembly 46 may be formed from attaching the bottom member 68 between a pair of the side members 62. Further, a pair of the internal connection members 56 may be attached to the side members 62. The bottom rail assembly 46 or more specifically, the bottom member 68 may operatively engage a threshold 96 in any appropriate manner upon the entry door 10 being attached to the jamb frame 12.

As noted above, the internal connection members 56 may include the pair of the snap fit female members 82 and the side members 62 may each include the pair of male members 80 and the snap fit female member 81. The bottom member 68 may include at least one snap fit member 104, such as by way of a non-limiting example, a pair of male snap fit members 104 capable of engaging the female snap fit members 81 of each of the side members 62.

The snap fit members 80, 81, 82 and 104 may be selectively engaged in any appropriate manner, such as shown in FIG. 2. The snap fit members 80, 81, 82 and 104 may be snap fit manually by hand, utilizing appropriate machinery or a combination of such. Once the snap fit members 80, 81, 82 and 104 are engaged, an adhesive may be used to fixedly engage the snap fit members 80, 81, 82 and 104 together. Any appropriate adhesive may be used without departing from the present teachings. Alternatively, the snap fit members 80, 81, 82 and 104 may be attached through any appropriate process, including, without limitation, fastening, welding or the like. Attaching the snap fit members 80, 81, 82 and 104 may form the bottom rail assembly 46.

While the order of the components forming the side stile assemblies 42, top rail assembly 44 and bottom rail assembly 46 being assembled is described above generally in a specific order, the present teachings are not limited to such. The components may be assembled in any appropriate order. Further, steps may be skipped or combined without departing from the present teachings.

Once the side stile assemblies 42, top rail assembly 44 and bottom rail assembly 46 are formed, they may be attached to one another in any appropriate manner. By way of a non-limiting example, the side stile assemblies 42, top rail assembly 44 and bottom rail assembly 46 may be attached by using adhesives, fasteners, welding, or the like. Alternatively, they may be attached through an integral or monolithic connector formed thereon. This may form the rail and stile structure 40, which as noted above may act as a frame structure for the entry door 10. Once assembled, the first and second skins 24, 28 may be attached to the rail and stile structure 40 in any appropriate manner.

The header 50, internal connection members 56, side members 62, bottom member 68, and edge member 74 may be a combination of components as shown in FIGS. 11-15. The components may be made of any appropriate material, including, without limitation, extruded plastic, pultruded fiberglass, polyurethane, rigid PVC, acetal, and the like. The components may interconnect with one another in any appropriate manner. The header 50, internal connection members 56, side members 62, bottom member 68, and edge member 74 and their corresponding snap fit members 80, 81, 82, 94 and 104 may each be formed as a monolithic unit.

The rail and stile structure 40 being formed from the header 50, internal connection members 56, side members 62, bottom member 68, and edge members 74 may result in a generally hollow entry door 10. Specifically, such components when attached may be generally spaced from one another. This may form a hollow portion 108 within the entry door 10 between the first and second skins 24, 28. The hollow portion 108 may be generally filled with an insulative material 120. The entire hollow portion 108 may be filled with the insulative material 120, or in the alternative, a portion of the hollow portion 108 may be filled with the insulative material 120.

The insulative material 120 may be any appropriate material, including, without limitation, polyurethane foam, polyethylene foam, granular cellulose, honeycomb cellulose, fiberglass batting, and the like. When utilizing polyurethane foam, or any other foam insulation, it may be sprayed within the hollow portion 108 or the applicable portion thereof in any appropriate manner. Alternatively, the hollow portion 108 may be filled with a liquid insulation. The liquid insulation may be poured or sprayed in. Further, solid insulation may be inserted into the hollow portion 108 or the applicable portion thereof. The present teachings are not limited to a specific configuration of insulation. Including the insulative material 120 within the hollow portion 108 may result in the entry door 10 having a higher insulating factor than other prior art doors, including, without limitation wood doors. By way of a non-limiting example, adding the insulative material 108 within the hollow portion 120 may result in an entry door having an insulating factor of at least R–10.

Additional embodiments of an entry door according the present teachings are described below. In the descriptions, all of the details and components may not be fully described or shown. Rather, the features or components are described and, in some instances, differences with the above-described embodiments may be pointed out. Moreover, it should be appreciated that these additional embodiments may include elements or components utilized in the above-described embodiments although not shown or described. Thus, the descriptions of these additional embodiments are merely exemplary and not all-inclusive nor exclusive. Moreover, it should be appreciated that the features, components, elements and functionalities of the various embodiments may be combined or altered to achieve a desired entry door without departing from the spirit and scope of the present teachings.

Figure 19:
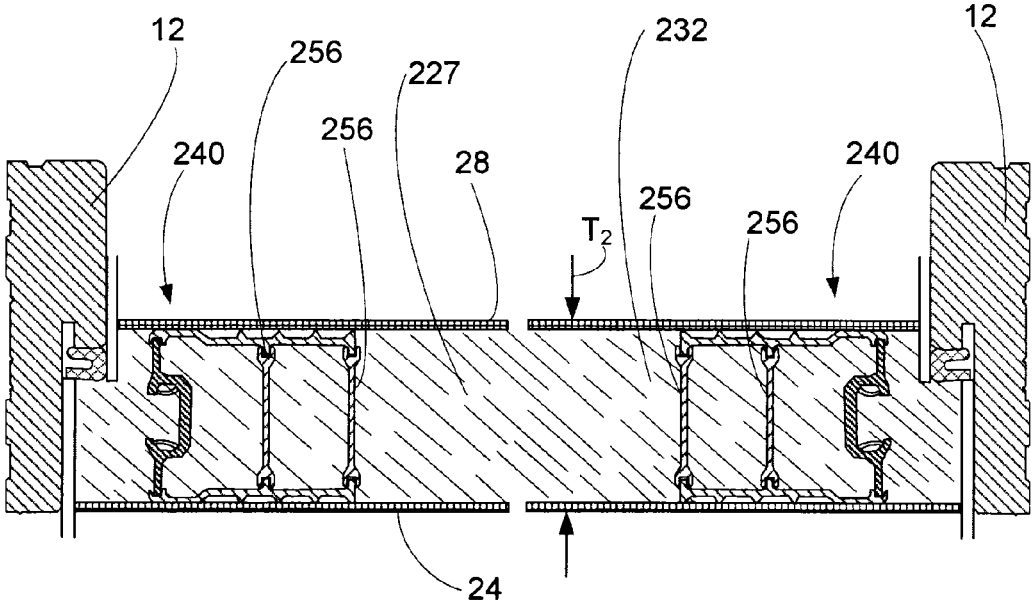
FIG. 19 is a vertical cross-sectional view of an additional embodiment of an entry door.

An entry door 200 such as that shown in FIG. 19 may include an overall thickness $T_2$ that greater than the thickness $T_1$ of the entry door 10 of FIG. 3. The entry door 200 having a greater thickness may generate a larger hollow portion 227. The larger hollow portion 227 may have included therein a greater amount of insulative material 232. Increasing the amount of insulative material 232 in the entry door 200 may increase the insulating factor of the entry door 200.

The thickness of the entry door 200 may be increased by utilizing longer internal connection members 256 than those of the entry door 10. Utilizing longer internal connection members 256 with the rail and stile structure 240 may increase the distance between the first and second skins 24, 28. This may then increase the amount of available open area between the first and second skins 24, 28, or more specifically, increases the available hollow portion 227. More insulative material 232 may be inserted between the first and second skins 24, 28. This may result in the entry door 200 having better insulative properties, including having a higher insulating factor.

Further, the thicker entry door 200 may include end members 76 similar to the entry door 10. This may allow the thicker entry door 200 to fit on a standard rabbeted jamb frame 12. This may be accomplished by an offsetting rabbet around the exterior edges of the entry door 200. This may provide the entry door 200 with an offset edge resulting in four 90 degree corners—specifically three outside corners and one inside corner—as opposed to two 90 degree corners in prior art versions. These additional corners may provide additional surface area for an extra bead of weather-stripping and may further block a significant amount of light, air and noise infiltration. This placement of the weather-stripping may result in better properties to prevent water leakage and air or light infiltration. The gap between the two beads of weather-stripping may provide a cavity that acts as a weeping system for water infiltration as well as improve sound-deadening properties as further described above.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

Having thus described the invention, the following is claimed:

1. An entry door comprising:
a first skin;
a second skin;
at least one stile, the stile comprising:
an elongated edge member;
at least one stile side member engaged with the elongated edge member; and
a plurality of stile cross members attached with and extending generally perpendicular to the at least one stile side member, wherein the plurality of stile cross members are spaced apart from each other;
at least one rail, the rail comprising:
an elongated header;
at least one rail side member engaged with the elongated header; and
a plurality of rail cross members attached with and extending generally perpendicular to the at least one rail side member, wherein the plurality of rail cross members are spaced apart from each other;
wherein the at least one rail and stile are positioned between and secured with the first and second skins forming a cavity between the first and second skins; and
an insulative material positioned between the first and second skins generally filling the cavity.

2. The entry door of claim 1, wherein at least one of the first and second skins is steel.

3. The entry door of claim 2, wherein the other of the first and second skins is fiberglass.

4. The entry door of claim 1, wherein the at least one stile side member includes first and second side members, whereby the first and second side members are substantially identical.

5. The entry door of claim 1, further comprising an end member engaged with the elongated edge member, wherein the end member includes a rabbeted edge.

6. The entry door of claim 5, wherein the rabbeted edge is engageable with a jamb frame on at least two sides of the jamb frame.

7. The entry door of claim 1, wherein the plurality of stile cross members being spaced apart from each other forms a space whereby the insulative material is insertable in the stile.

8. The entry door of claim 1, wherein the plurality of rail cross members being spaced apart from each other forms a space whereby the insulative material is insertable into the rail.

9. The entry door of claim 1, wherein increasing lengths of the stile and rail cross members increases a size of the cavity for the insulative material.

10. The entry door of claim 1, wherein the insulative material includes polyurethane foam.

11. The entry door of claim 1, wherein the at least one stile includes first and second stiles having substantially similar configuration.

12. The entry door of claim 1, wherein the at least one rail includes first and second rails whereby the first rail includes the elongated header.

13. The entry door of claim 1, wherein the second rail comprises:

an elongated bottom member;

at least one bottom rail side member engaged with the elongated bottom member; and a plurality of bottom rail cross members attached with and extending generally perpendicular to the at least one bottom rail side member, wherein the plurality of bottom rail cross members are spaced apart from each other.

14. The entry door of claim 13, wherein the rail cross members and the bottom rail cross members are of substantially similar configuration.

15. An entry door comprising:

a first skin;

a second skin;

a pair of stiles, wherein a first stile of the pair of stiles comprises:

an elongated edge member;

at least one stile side member engaged with the elongated edge member; and a plurality of stile cross members attached with and extending generally perpendicular to the at least one stile side member, wherein the plurality of stile cross members are spaced apart from each other;

a pair of rails, wherein a first rail of the pair of rails comprises:

an elongated header;

at least one rail side member engaged with the elongated header; and a plurality of rail cross members attached with and extending generally perpendicular to the at least one rail side member, wherein the plurality of rail cross members are spaced apart from each other;

wherein the pair of stiles and rails are positioned between and secured with the first and second skins forming a cavity between the first and second skins; and an end member attached to the elongated edge member, wherein the end member includes a generally perpendicular internal corner capable of engaging at least two surfaces of a jamb.

16. The entry door of claim 15, wherein the internal corner includes first and second surfaces having weathering stripping attached thereto.

17. The entry door of claim 16, wherein the elongated header includes a generally perpendicular internal corner capable of engaging at least two surfaces of a header portion of the jamb.

18. The entry door of claim 17, wherein the internal corner of the elongated header includes first and second surfaces having weathering stripping attached thereto.

19. The entry door of claim 15, further comprising a foam insulative material positioned between the first and second skins generally filling the cavity.

20. The entry door of claim 19, wherein the stile and rail cross members have generally equivalent lengths, whereby increasing the lengths of the stile and rail cross members increases a size of the cavity for the foam insulative material.

21. The entry door of claim 15, wherein a second rail of the pair of rails comprises:

an elongated bottom member;

at least one bottom rail side member engaged with the elongated bottom member; and a plurality of bottom rail cross members attached with and extending generally perpendicular to the at least one bottom rail side member, wherein the plurality of bottom rail cross members are spaced apart from each other.

22. The entry door of claim 21, wherein the elongated header forms a header of the first rail engageable with a header of a door jamb and the elongated bottom member forms a bottom of the second rail engageable with a bottom of a door jamb.

23. An entry door comprising:

a jamb attachable to an opening in a building structure, the jamb having a width;

a first skin;

a second skin;

a pair of stiles, wherein at least one of the pair of stiles comprises:

an elongated edge member;

at least one stile side member engaged with the elongated edge member; and a plurality of stile cross members attached with and extending generally perpendicular to the at least one stile side member, wherein the plurality of stile cross members are spaced apart from each other;

top and bottom rails, wherein the top rail comprises:

an elongated header;

at least one rail side member engaged with the elongated header; and a plurality of rail cross members attached with and extending generally perpendicular to the at least one rail side member, wherein the plurality of rail cross members are spaced apart from each other;

wherein the pair of stiles and rails are attached together, positioned between and secured with the first and second skins forming a cavity between the first and second skins whereby at least one of the pair of stiles is connected with the jamb; and wherein the first skin extends beyond the width of the jamb.

24. The entry door of claim 23, further comprising an end member attached to the elongated edge member, wherein the end member includes a generally perpendicular internal corner capable of engaging at least two surfaces of the jamb.

25. The entry door of claim 24, wherein the elongated header includes a generally perpendicular internal corner capable of engaging at least two surfaces of a head portion of the door jamb.

26. The entry door of claim 23, further comprising a foam insulative material positioned between the first and second skins generally filling the cavity.

27. The entry door of claim 26, wherein the at least one stile side member includes first and second stile side members spaced apart and attached with the elongated edge member.

28. The entry door of claim 27, wherein the elongated edge member and the first and second stile side members being attached together forms a stile cavity.

29. The entry door of claim 28, wherein the plurality of stile cross members are spaced apart from one another in the stile cavity.

30. The entry door of claim 29, wherein the insulative material substantially fills the stile cavity.

31. The entry door of claim 27, wherein the wherein the at least one rail side member includes first and second rail side members spaced apart and attached with the elongated header.

32. The entry door of claim 31, wherein the elongated header and the first and second rail side members being attached together forms a rail cavity.

33. The entry door of claim 32, wherein the plurality of rail cross members are spaced apart from one another in the rail cavity.

34. The entry door of claim 33, wherein the insulative material substantially fills the rail cavity.

35. The entry door of claim 27, wherein the bottom rail comprises:

an elongated bottom member;

at least one rail bottom side member engaged with the elongated bottom member; and a plurality of rail bottom cross members attached with and extending generally perpendicular to the at least one rail bottom side member, wherein the plurality of rail bottom cross members are spaced apart from each other.

36. The entry door of claim 35, wherein the wherein the at least one rail bottom side member includes first and second rail bottom side members spaced apart and attached with the elongated bottom member.

37. The entry door of claim 36, wherein the elongated bottom member and the first and second stile bottom side members being attached together forms a bottom rail cavity.

38. The entry door of claim 37, wherein the plurality of rail bottom cross members are spaced apart from one another in the bottom rail cavity.

39. The entry door of claim 38, wherein the insulative material substantially fills the bottom rail cavity.

* * * * *